United States Patent [19]

Gallagher

[11] 4,389,635

[45] Jun. 21, 1983

[54] INTERFACING ATTACHMENT FOR REMOTE MECHANICAL FIRE ALARMS

[75] Inventor: Edward L. Gallagher, Dana Point, Calif.

[73] Assignee: A-T-O, Inc., Willoughby, Ohio

[21] Appl. No.: 211,382

[22] Filed: Nov. 28, 1980

Related U.S. Application Data

[63] Continuation-in-part of Ser. No. 206,003, Nov. 12, 1980, abandoned.

[51] Int. Cl.[3] ..... G08B 25/00; G08B 1/08

[52] U.S. Cl. ..... 340/287; 335/205; 340/307; 340/539

[58] Field of Search ..... 340/287, 531, 539, 288, 340/306, 307, 308, 299; 200/61.18, 61.41, 81.9 M, 61.13; 116/106; 368/12; 335/205

[56] References Cited

U.S. PATENT DOCUMENTS

| | | | |
|---|---|---|---|
| 3,579,159 | 5/1971 | Posey | 335/205 |
| 3,804,054 | 4/1974 | Gallagher | 116/106 |
| 3,931,785 | 1/1976 | Keeley et al. | 116/106 |

FOREIGN PATENT DOCUMENTS

| | | | |
|---|---|---|---|
| 891349 | 3/1962 | United Kingdom | 368/12 |

*Primary Examiner*—John W. Caldwell, Sr.
*Assistant Examiner*—Daniel Myer
*Attorney, Agent, or Firm*—Knobbe, Martens, Olson, Hubbard & Bear

[57] ABSTRACT

An attachment which converts a single station, spring powered, temperature sensitive, fire alarm protection device into a remote signalling heat detector for a central fire alarm system, without affecting the internal apparatus of the alarm device or the environmental protection of such internal apparatus. The attachment includes a pivotally mounted member having a shield arm interposed between a magnet and a reed switch, and a lever arm which interacts with a winding key on the alarm device to move the shield arm from between the magnet and reed switch when the alarm is actuated. This movement of the shield arm permits the magnetic force of the magnet to activate the reed switch. The reed switch is connected by wire or radio link to a central monitor. Actuation of the reed switch, in response to actuation of the alarm device, produces an alarm signal at the central monitor.

16 Claims, 9 Drawing Figures

Fig. 2
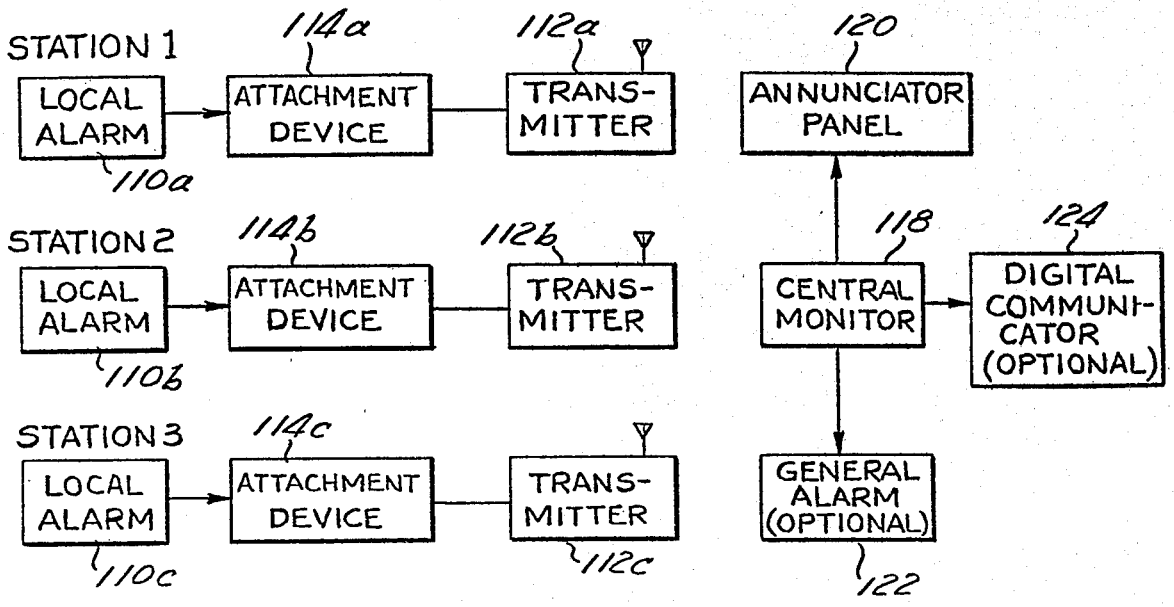
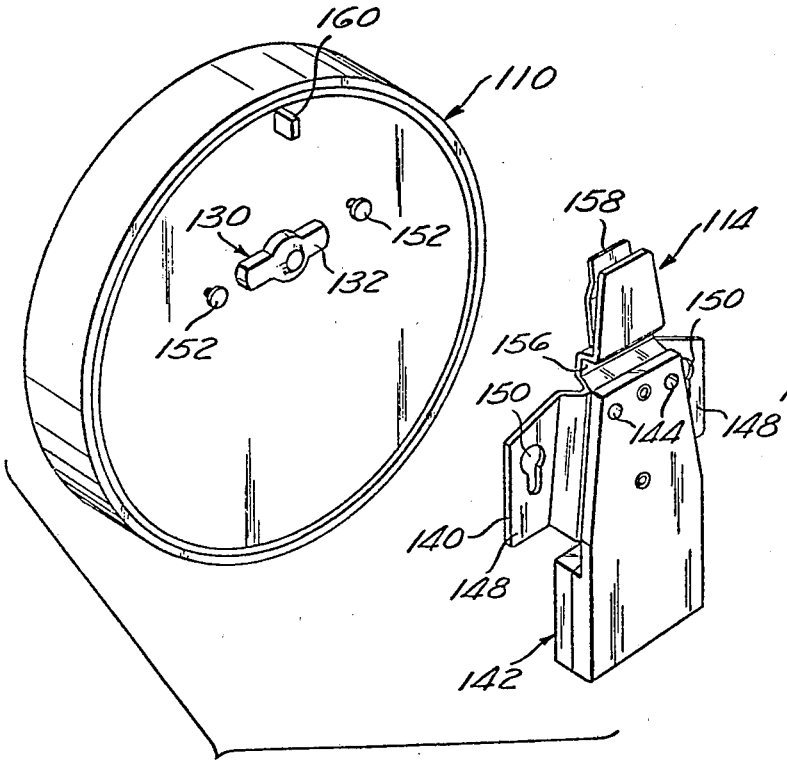
Fig. 1
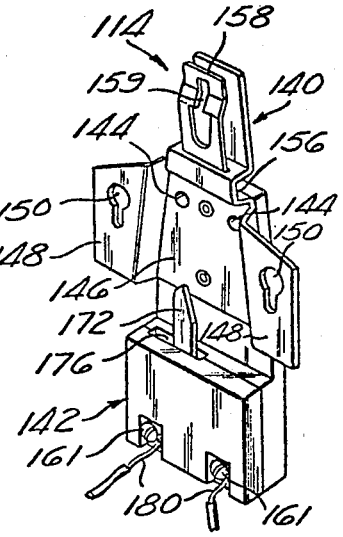
Fig. 4

INTERFACING ATTACHMENT FOR REMOTE MECHANICAL FIRE ALARMS

BACKGROUND OF THE INVENTION

This application is a continuation-in-part of the application Ser. No. 06/206,003, filed Nov. 12, 1980, bearing the same title and same inventor as the present application, now abandoned.

This invention relates to attachments for converting single station, audible, mechanical fire alarms devices into remote signalling detectors for central fire alarms systems.

Alarm systems are commonly used in many households and commercial facilities to protect such premises and their occupants. Because of the reliance that building occupants place upon fire alarm systems, it is important that they be made as dependable as possible. For example, it is very important that the alarm have a dependable power supply which functions even though the commercial AC power supply may fail. The prior art has endeavored to provide such dependable power supply by providing mechanical energy storage devices, such as springs, which may be wound to a flexed position and which will unwind to power the device. Alarms having this type of power supply have been approved by U/L after passing rigorous test procedures to insure that the alarm will sound years after installation, and/or after exposure to adverse environments. Thus, mechanical, spring powered alarms are extremely reliable and are in widespread use. Such a mechanical alarm is illustrated by U.S. Pat. No. 3,804,054, which is incorporated herein by reference. This patent was issued to Edward L. gallagher, the inventor of the present invention, and assigned to A-T-O Inc., assignee of the present invention.

Although mechanically powered, single station alarms are very reliable, they have heretofore not been used in central alarm systems because they have been thought to be incapable of transmitting a signal to a central monitoring station in response to actuation of the alarm. Thus, the usefulness of these alarms has been limited to warning persons within the audible range of the individual, single station alarm. This is obviously disadvantageous since, if there are no occupants nearby, the alarm may not be heard, and therefore, a fire may significantly damage a building or block the escape routes of its occupants before the fire is discovered.

The most commonly used devices which provide an audible alarm in addition to transmitting a signal to a central monitoring station are smoke detectors. However, smoke detectors are inherently unsuitable for use in central alarm systems in which the detectors are located within living quarters or office, since they are frequently actuated by smoke generated from cooking, or by pipe, cigarette, or cigar smoke. Thus, the smoke alarms frequently transmit false alarms to the central monitoring station, thereby causing fire fighting equipment to be needlessly dispatched. Further, if the smoke alarms are connected to trigger a general alarm, it is apparent that such false alarms may greatly inconvenience building occupants. Moreover, if the false alarms occur with regularity, building occupants may tend to ignore the alarms.

In order to eliminate or reduce such false alarms, building owners and managers typically connect to the central monitoring station only the smoke detectors located in corridors, or other common areas where false alarms would be unlikely to occur. The smoke detectors located within the living quarters or offices sound a localized alarm signal only within the apartment or office in which they are mounted. It will be apparent, however, that such a system is far from optimal, since, if a fire starts in unoccupied living quarters or office spaces, the fire may rage out of control before the smoke reaches the corridor and activates a smoke detector.

SUMMARY OF THE INVENTION

The present invention solves these and other problems of the prior art by providing an attachment which interfaces a mechanically operated alarm with either a transmitter or central alarm circuit to permit signals to be transmitted to a remotely located central monitor.

This attachment includes an electrical switch in juxtaposition to a permanent magnet, with a shield member interposed therebetween. The electrical switch has respective on and off states controllable by applying the magnetic field of the permanent magnet to it. A lever arm, attached to the shield, is provided to move the shield from a first position between the magnet and switch, to a second position, at least partially removed from between the magnet and switch. Thus, when the shield is in its first position, it blocks or shuts the magnet field to prevent it from activating the switch. However, when the shield is moved by the lever arm to its second position, the switch is exposed to sufficient magnetic force to cause it to be activated. Therefore, the switch changes electrical states in response to selective exposure to the magnetic field of the permanent magnet. The terminals of the switch are connected to either the transmitter or, alternatively, to the alarm circuit. By moving the lever arm to activate the switch, the transmitter of alarm circuit will be activated to send a signal to the central monitor.

It is a feature of this invention that the strength of the magnetic field may be substantially greater than is necessary to activate the switch. This enhances the reliability of the attachment device, since a relatively strong magnetic field insures consistent activation of the switch, even if the shield, when raised to its second position, does not expose the switch to the entire magnetic field of the magnet. Moreover, it is significant that minor misalignment of the juxtaposed magnet and switch will not adversely affect the operation of the device. Thus, the manufacturing tolerances of the device are not critical.

The attachment is mounted on the mechanically operated alarm in a position which permits its lever arm to interact with the alarm mechanism and actuate the electrical switch in response to actuation of the alarm. This is advantageously accomplished by providing a bracket, which advantageously is also used to mount the alarm on a wall. The bracket has a recessed area, sized to accommodate a winding key protruding from the back of the alarm housing. The winding key is connected to the axle of an energy storage spring within the alarm. When the alarm is actuated, the spring will unwind, thereby rotating the winding key. The lever arm of the attachment is aligned with the handle of the winding key, and is positioned to permit the winding key handle to move the lever arm as the key handle rotates. Since such movement of the lever arm actuates the switch, the transmitter or alarm circuit will be activated to send a signal to the central monitor. The attachment of the present invention, therefore, permits a mechanically operated alarm to be interfaced with a transmitter or alarm circuit, and thereby combines the reliability of mechanically operated alarms with the advantages of a central alarm system.

A feature of this invention is that the attachment is designed to automatically return the lever arm and thereby reset the switch after it has been moved by the rotation of the winding key.

A further feature of this invention is that the attachment may be mounted directly on the alarm without disassembling the alarm or affecting its structural integrity or internal mechanism in any way. Thus, any seals or environmental protection incorporated into the alarm will remain undisturbed by the addition of the attachment. Further, as will be understood more fully below, the operation of the attachment will not adversely affect the operation of the alarm. That is, the attachment will not inhibit the alarm from operating in its normal manner. Accordingly, the addition of the attachment device will not reduce the safety or the reliability of the alarm. Moreover, the preferred embodiment of the invention, as described in detail below, permits existing single station, mechanically operated alarms to be retrofitted so that the existing alarms may be added to a central alarm system at low cost.

For added safety, it is preferable to locate alarms at a number of strategic locations throughout a building or residence. Each alarm, therefore, provides protection for a portion or "zone" of the building. The mechanically operated alarms used with the attachment device of the present invention are particularly advantageous for such "zoned" fire alarm systems, since they sound a local, audible alarm in addition to sending a signal to the central monitor. Such audible alarm indicates the general location of the fire to building occupants or others, and therefore, provides information necessary to properly respond to the fire, or to escape in a safe direction, away from the fire. Further, such audible zoning may be helpful to parents in indicating the location of a fire relative to children that may need to be rescued.

Mechanically operated, single station fire alarms, such as that disclosed in U.S. Pat. No. 3,804,054, are particularly suitable for the present invention. These alarms have mechanical energy storage devices, such as springs, which may be wound to a flexed position, and which will unwind to power the alarm. Since their mechanical energy may be stored indefinitely without being depleted by passage of time, these alarms are extremely reliable. Further, since these alarms utilize heat detectors, rather than smoke detectors, the possibility that false alarms will be generated is virtually eliminated.

A feature of the present invention is that it enables a single station alarm to be inexpensively converted into a remote signalling temperature detector for a central fire alarm system. In such a central alarm system, the single station alarm, when activated, initiates the transmission of a signal to the central monitor, continually observed, for example, by an attendant. This is accomplished by utilizing the attachment device to interface the mechanical alarms with the previously mentioned transmitters or, alternatively, with direct wired alarm circuits. If transmitters are used, the attachment device, in response to actuation of a single station alarm, activates its respective transmitter to enable it to send a signal to the central monitor. Although the transmitters will typically be powered by batteries, it should be noted that, even if the transmitter fails to function because of low battery power, the mechanically powered alarm will still function. Thus, persons in the vicinity of the alarm will be alerted to the fire danger immediately and will not have to rely solely on the transmitters for their safety. Similarly, if respective direct wired alarm circuits are used, rather than transmitters, the attachment device will close the circuit in response to actuation of the alarm, and thereby signal the monitor that the alarm has been actuated. However, it should be noted that if the alarm circuit, for some reason, fails to function, the single station alarm will still function, since it is not dependent upon any electrical power supply. Thus, persons in the vicinity of the alarm will be alerted to the fire danger, regardless of the operability of the alarm circuit. Therefore, regardless of whether the mechanically operated alarm is used in combination with the transmitter or the alarm circuit, the alarm system is extremely reliable, since it sounds at least a local alarm, even if the central alarm or monitor fails to function.

Further, this alarm system is extremely flexible and versatile, particularly when transmitters are used. For example, since both the alarm and the transmitter are independent of the building power supply, they may be installed at any suitable location without expensive electrical modifications. Moreover, virtually any number of alarm/transmitter combinations can report to the central monitor. As an alternative to or compliment to the central monitor, the transmitters or alarm circuits may also be adapted to trigger a general alarm to permit all building occupants to be simultanously alerted to the fire hazard. Furthermore, a digital communicator, activated by the monitor in response to the signals received from the transmitters or alarm circuits, may be included to notify the fire department, a central monitoring service, or others to provide an additional safeguard. A further feature of the present invention is that the frequency and audible tone duration of intermittent alarm signals produced by a general alarm may be varied by increasing or decreasing the number of radial members on the winding key.

BRIEF DESCRIPTION OF THE DRAWINGS

FIG. 1 is a perspective view of the attachment, positioned to be mounted on the back of an alarm;

FIG. 2 is a schematic drawing illustrating that the single station alarms activate their respective attachment devices which, in turn, activate respective transmitters to provide a signal to the central monitor;

FIG. 4 is a perspective view of the attachment showing the lever arm protruding through the slot in the switch assembly housing, and showing the configuration of the mounting bracket which permits the attachment to be mounted and locked in position on the back of the alarm without inhibiting rotation of the winding key;

DETAILED DESCRIPTION OF THE PREFERRED EMBODIMENT

Figure 5:
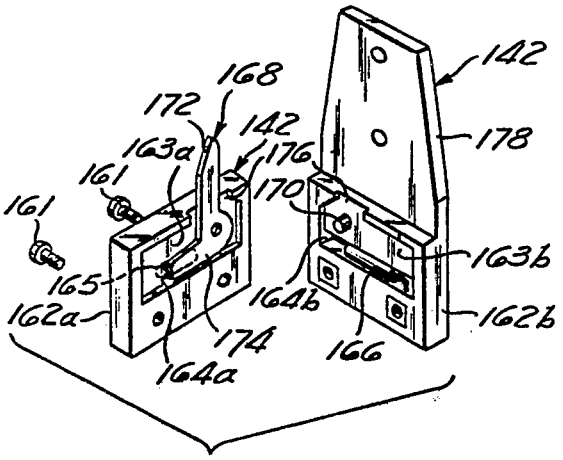
FIG. 5 is an exploded perspective view of the switch assembly showing that the shield is interposed between the magnet and switch, and is connected to the lever arm.

The preferred embodiment of the present invention includes an attachment device 114 which attaches to a single station, mechanical, spring powered, temperature sensitive, fire alarm protection device 110, as shown in FIG. 1. The attachment device 114 connects the single station alarm 110 into a remote signaling temperature detector for a central fire alarm system, without affecting either the internal apparatus of the alarm 110 or the environmental protection for such internal apparatus.

OPERATION OF THE PRESENT INVENTION IN A CENTRAL FIRE ALARM SYSTEM

A representative alarm system employing the present invention includes one or more local, audible alarms 110(*a*) through (*c*) placed at respective strategic locations or stations 1 through 3 throughout a building or group of buildings, as shown schematically in FIG. 2. The alarms 110(*a*) through (*c*) are mechanically operated, are actuated by a heat detector, and are connected to respective electronic transmitters 112(*a*) through (*c*) through the respective attachment devices 114(*a*) through (*c*). Further, the transmitters 112 are located in proximity to their respective alarms 110. As will be understood more fully below, when one of the alarms 110 is actuated, its respective attachment device 114 responsively closes a circuit which activates its respective transmitter 112. The transmitters 112 are preferably of the radio frequency type, however, it will be understood that other types of transmitters, such as line carrier transmitters, may be used alternatively. After being activated by the attachment device 114, the transmitter 112 responsively sends a radio frequency signal to a central monitor 118, which is installed in a location remote from the transmitters 112. In response to receipt of this signal, the central monitor 118 decodes the signal and indicates on an annunciator panel 120, by visual displays and/or audio alarms, the location of the particular alarm 110 and transmitter 112 which initiated the signal. Thus, the annunciator panel 120 not only shows that an alarm 110 has been actuated, but also indicates which one of the alarms 110 was actuated.

The central monitor 118 may also be connected to various types of optional equipment. For example, a general alarm 122, comprising centrally located sirens or bells, may be provided to alert all building occupants that one or more of the local alarms 110 has been actuated. It will be understood that, alternatively, the general alarm or a series of general alarms may be activated directly by the transmitter signals. In addition, a digital communicator 124 may be provided to automatically notify the fire department, a central monitoring service, or others of such actuation of one of the alarms 110.

It is preferable to use battery powered transmitters 112 with the mechanically operated alarms 110 to permit the alarms 110 and their respective transmitters 112 to be placed in any suitable location, without regard to availability of AC power. However, since batteries tend to lose their charge during prolonged periods of non-use, there is a risk that the transmitters 112 will not function if the batteries are not replaced regularly. In such event, a fire would not be detected at the monitor 118 since it would not receive a signal from the transmitter 112. However, it should be noted that even if the transmitter 112 fails to function, the alarms 110 will still function since their mechanical energy may be stored indefinitely without depletion. Thus, persons in the vicinity of the local alarm 110 would be alerted to the fire danger, even if the signal were not received by the central monitor 118. Therefore, since the alarm system of the present invention does not rely entirely upon batteries or other electrical power, it is extremely reliable.

In an alternative system, the transmitters 112 may be replaced by respective direct wired alarm circuits 116 (FIG. 9) to permit the attachment devices 114 to be direct-wired to the monitor 118. When a local alarm 110 is actuated, its attachment device 114 closes its respective direct-wired alarm circuit 116. Current supplied from the central monitor 118 flows through the circuit 116, thereby indicating to the central monitor 118 that an alarm 110 has been actuated. The location of the actuated alarm 110 is indicated on the annunciator panel 120 and the optional equipment 122,124 may be activated in the same manner as described for the transmitters 112, above. The central monitor 118 and its associated equipment 120,122,124 are normally powered by ordinary household current. However, a large capacity, self-recharging power supply (not shown) is included to provide emergency power during power outages. Thus, the power supply of the equipment 118,120,122,124 is very dependable. Therefore, the direct-wired circuits 116 provide a dependable and reliable alarm system.

It will be understood that, to reduce wiring requirements for the circuits 116, the attachment devices 114 of a group of alarms 110 may be direct-wired to a centrally located transmitter (not shown). For example, the alarms 110 of each of the floors of a high-rise building may be direct-wired to such a transmitter. These transmitters, which may be equipped with a dependable power supply similar to that of the central monitor 118, send a signal to the central monitor 118 in response to actuation of any of their respective alarms 110.

DESCRIPTION OF THE ALARMS 110

Figure 3:
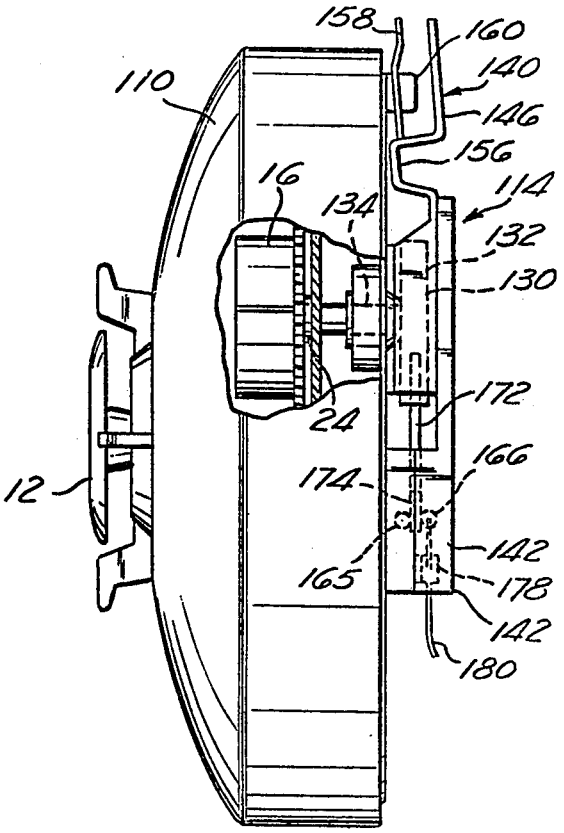
FIG. 3 is an elevational view of the attachment device mounted on the alarm illustrating that the lever arm is aligned with the winding key handle to permit rotation of this handle to move the lever arm (the alarm housing is partially cut away to show the connection between the alarm spring and the winding key handle)

The alarm 110 is preferably a mechanically powered, single station alarm of the type disclosed in U.S. Pat. No. 3,804,054, which is incorporated herein by reference. As shown in FIG. 3, a fuse assembly 12 is included to permit the alarm 110 to trigger when the room temperature reaches a predetermined level. A winding key 130, shown also in FIG. 1, is comprised of a handle 132 and a shaft 134. The key 130 provides means for winding an energy storage spring 16 which powers the alarm 110. The winding key shaft 134 is inserted through a hole in the back of the alarm 110 and is connected to an axle 24 about which the spring 16 is wound. When the room temperature reaches a level sufficient to permit the fuse 12 to trigger the alarm 110, the spring 16 will unwind and thereby rotate the axle 24 and the winding key 130.

MOUNTING THE ATTACHMENT DEVICE 114 ON THE ALARM 110

The attachment device 114 comprises an alarm mounting bracket 140 connected to a switch assembly 142, as shown in FIGS. 1 and 4. Mounting holes 144 are provided to permit the device 114 to be mounted on a wall with fasteners such as screws (not shown). The bracket 140 has a central portion 146 having respective L-shaped members 148 on opposite sides. The members 146 and 148 are sized and positioned to permit the bracket 140 to be connected to the back of the alarm 110 without inhibiting the rotation of the winding key handle 132. A pair of key-shaped slots 150 on each of the L-shaped members 148 receive bolt-shaped projections 152 on the back of the alarm 110 to permit the attachment device 114 to be mounted thereon. The central portion 146 of bracket 140 extends to the top edge of the alarm 110, and a U-shaped channel 156 is formed in such upper extension of the bracket 140. The channel 156 has a depth which permits it to nearly touch the back of the alarm 110. A resilient flexible flange 158 is connected to the base of the U-shaped channel 156. The flange 158 extends in a direction parallel to the upper extension of bracket 140, and has a slot 159 which receives a projection 160 extending perpendicularly from the back of the alarm 110. As shown in FIG. 3, the slot 159 cooperates with the projection 160 to form a lock which prevents the alarm 110 from being inadvertently or accidentally disengaged from the attachment device 114. The lock may be disengaged simply by bending the flange 158 towards the central portion 146 so that the flange 158 clears the projection 160. This permits the alarm 110 to be removed from attachment device 114 by sliding the alarm 110 so that the bolt-shaped projections 152 align with the heads of the key-shaped slots 150.

Thus, the attachment device 114 may be mounted directly on the alarm 110 without disassembling it, or affecting its structural integrity or environmental protection in any way. Consequently, the reliability of the alarm 110 is not affected by attachment of the device 114. Further, since disassembly or modification of the alarm 110 is not required, the device 114 may be simply and easily attached to existing single station alarms by non-technical personnel. This permits existing single station alarms to be added to a central alarm system at modest cost.

DESCRIPTION OF THE SWITCH ASSEMBLY

As shown in FIG. 5, the switch assembly 142 includes a housing comprised of a pair of blocks 162(*a*), 162(*b*) fastened together by screws 161 (FIG. 4) or other suitable means. The mating surfaces of the blocks each have a recess 163(*a*) and 163(*b*), respectively. Within each of the recesses 163(*a*) and 163(*b*) are second smaller recesses 164(*a*),164(*b*), respectively, which are sized to accommodate a permanent magnet 165 and a reed switch 166, respectively. By way of specific example, the magnet 165 may comprise an Alnico V, magnetized and stabilized, having a diameter of about ⅛-inch and a length of about ⅝-inch, and the switch 166 may comprise a normally open reed switch, such as switch No. 750-2053, manufactured by Flair Electronics, Inc., of Glendora, Calif. However, other combinations of magnets and reed switches will be apparent to those skilled in the art. Further, as will be understood more fully below, a normally closed reed switch may be substituted for the normally open reed switch 166.

Any suitable means, such as an adhesive, may be used to retain the magnet 165 and reed switch 166 within their respective recesses 164(*a*),164(*b*). The recesses 164 are positioned to permit the magnet 165 and reed switch 166 to be juxtaposed when the blocks 162 are fastened together. This permits the reed switch 166 to be exposed to the magnetic field of the magnet 165. As is well known, such exposure of the normally open reed switch 166 to the magnetic field will close the switch 166.

An L-shaped member 168, made from a magnetizable material, such as steel, is pivotally mounted on a shaft 170 within the cavity formed by the recesses 163 of the assembled blocks 162. The L-shaped member 168 is comprised of a lever arm 172 and a shield arm 174 which are perpendicularly connected to each other at the pivot point of the member 168. The lever arm 172 extends through a slot 176 (FIG. 4) formed by the recesses 163, while the shield arm 174 extends between the magnet 165 and the reed switch 166. Since the member 168 is of a magnetizable material, the shield arm 174 of the member 168 will shunt the magnetic field of the magnet 165 to prevent it from closing the switch 166. Thus, when the shield arm 174 is interposed between the magnet 165 and switch 166, the switch 166 will remain in its normally open state. However, when the lever arm 172 is moved through the length of the slot 176 (FIG. 4), the shield arm 174 will pivot to expose the switch 166 to the magnetic field of the magnet 165, and thus, the switch 166 will close. Therefore, the switch 166 opens and closes in response to the movement of the lever arm 172.

As noted above, the strength of the magnetic field produced by the magnet 165 is advantageously greater than is necessary to activate the switch 166. This insures that the switch 166 will be consistently activated even if it is not exposed to the entire magnetic field. In addition, minor misalignment of the juxtaposed switch 166 and magnet 165 will not adversely affect the operation of the attachment 114. Thus, the manufacturing tolerances of the component parts of the switch assembly 142 are not critical, and these component parts do not need to be assembled with precise dimensional tolerances.

INTERACTION OF THE ATTACHMENT DEVICE 114 WITH THE ALARM 110

Figure 6:
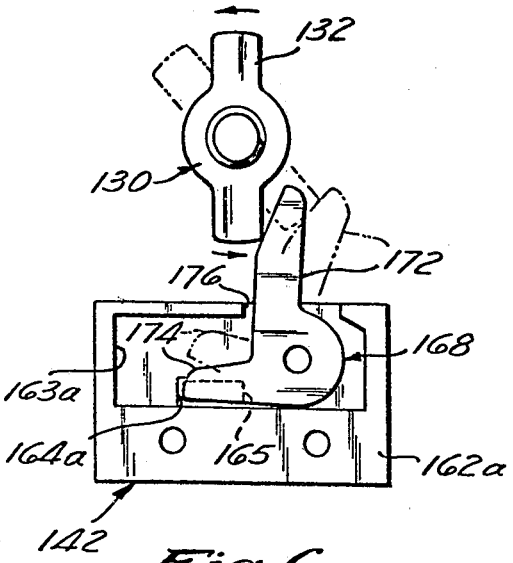
FIG. 6 is a schematic drawing showing the lever arm being moved through the length of the slot by the rotating winding key handle.

The block 162(*b*) has an integrally formed flange 178 which permits the switch assembly 142 of FIG. 5 to be connected to the above-described bracket 140, as shown in FIGS. 1 and 4, by rivets or other means. The attachment device 114, comprising the bracket 140 and assembly 142, is mounted on the back of the alarm 110, as shown in FIG. 3. The assembly 142 is positioned relative to the bracket 140 to permit the lever arm 172 to align with the winding key handle 132. Since the winding key handle 132 rotates when the alarm 110 is actuated, such alignment permits the rotating handle 132 to move the lever arm 172 through the length of the slot 176 (FIG. 4) and thereby pivot the L-shaped member 168 about the shaft 170, as shown in phantom in FIG. 6. This, as previously mentioned, will cause the shield arm 174 to pivot from its position between the magnet 165 and switch 166 to a position which exposes the switch 166 to the magnetic field. These two positions of the shield 174 will be referred to as the "home position" and the "raised position", respectively.

When the handle 132 rotates sufficiently to clear the lever arm 172, the shield 174 will automatically return from its raised position to its home position, thereby permitting the shield 174 to once again shunt the magnetic field. Such automatic return of the shield 174 is accomplished by positioning the magnet 166 relative to the shield 174, so that, after the shield 174 pivots to its raised position, the magnetic attraction between the magnet 165 and shield 174 is sufficient to draw the shield 174 to its home position. Therefore, the shield 174 will cyclically change positions as long as the handle 132 continues to rotate. Since the switch 166 is responsive to such changes of position, the switch 166 will also cyclically open and close. However, as will be understood more fully below, the attachment device 114 activates the transmitter 112 or alarm circuit 116 the first time the switch 166 closes. Thus, it is apparent that such cyclical opening and closing of the switch 166 is not essential to the operation of the present invention. However, it is preferable because it permits the switch 166 to automatically return to its normally open state without returning the shield 174 manually. Thus, such return of the shield 174 permits the switch 166 to always be ready to respond to subsequent actuation of the alarm 110. This is, of course, advantageous, since it would be easy to forget to manually return the shield 174 to its home position after the alarm 110 has been activated and the fire danger has passed. It will be understood, however, that other means, such as springs, may be used to automtically return the shield 174 to its home position after being lifted by the handle 132.

CONNECTING THE ATTACHMENT DEVICE 114 TO THE TRANSMITTER 112 OR ALARM CIRCUIT 116

Figure 7:
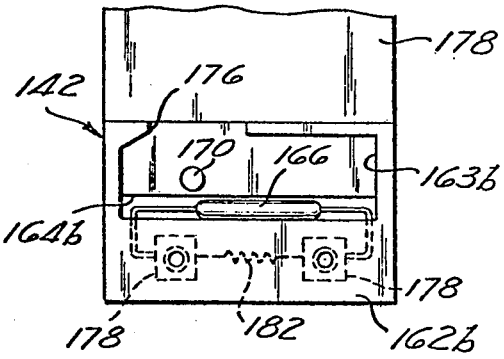
FIG. 7 is an elevational view of the portion of the switch assembly housing containing the reed switch which shows the terminals to which the switch is connected and a bleeder resistor therebetween for circuit test purposes.

The leads of the switch 166 are connected to respective terminals 178, as shown in phantom in FIG. 7. The terminals 178 may be connected to the transmitter 112 (FIG. 1) by wires 180 (FIG. 4). The closing of the switch 166 will complete the circuit created by the wires 180 and thereby cause the transmitter 112 (FIG. 1) to send a pulse through such circuit. This activates the transmitter 112, and thus enables it to send a signal to the central monitor 118 (FIG. 1).

Figure 9:
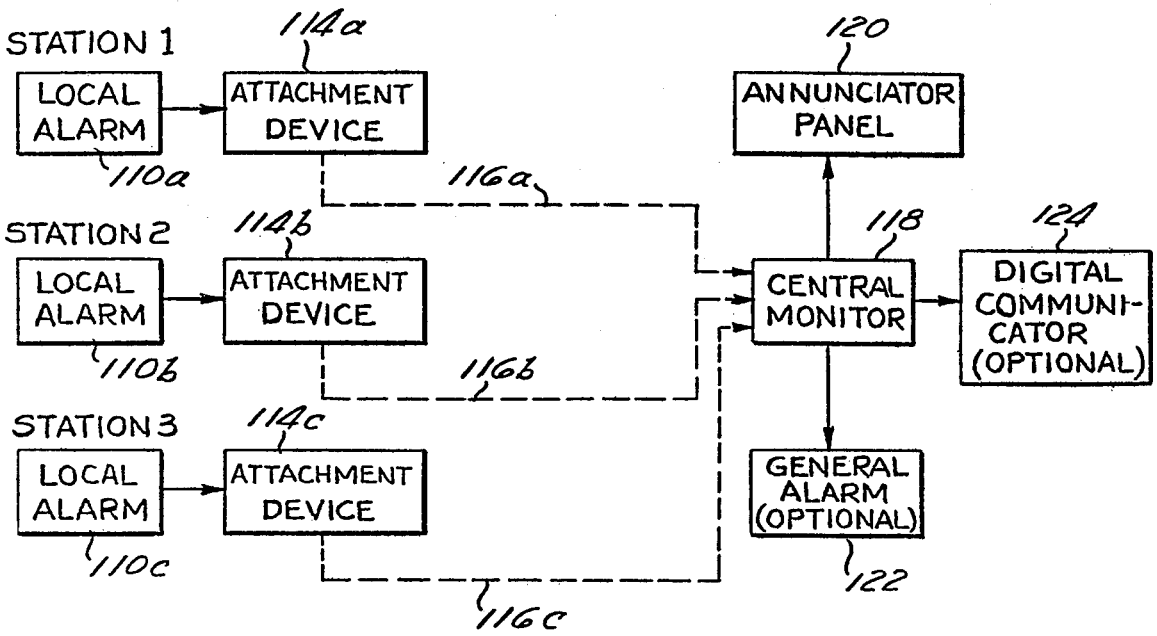
FIG. 9 is a schematic drawing illustrating that the single station alarms activate their respective attachment devices which, in turn, activate respective alarm circuits to provide a signal to the central monitor.

Alternatively, the wires 180 may be connected to one of the hard-wired circuits 116 (FIG. 9). In this case, it is preferable to connect a bleeder resistor 182 (shown in phantom in FIG. 7) 7 between the terminals 178. This resistor 182 permits a very small current to circulate through the hard-wired circuit 116, and thereby permits the circuit 116 to the continually tested for continuity by a circuit tester within the monitor 118 (FIG. 9). However, when the switch 166 is closed, this resistor 182 will be effectively shorted, and the circuits 116 will draw a much larger current which indicates to the monitor 118 that one of the alarms 110 has been actuated.

Thus, the attachment device 114 interfaces the alarm 110 with either the transmitter 112 or alarm circuit 116, and thereby permits the monitor 118 to receive a signal in response to actuation of the alarm 110.

DIRECT-WIRING THE ATTACHMENT DEVICE TO A GENERAL ALARM

Figure 8:
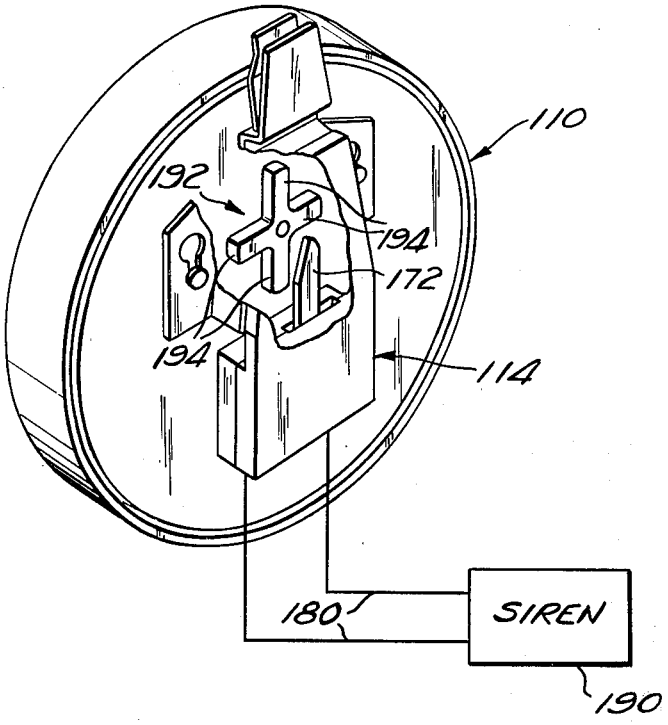
FIG. 8 is a perspective view of an alarm with the attachment device mounted thereon; the attachment device is partially cut away to show the interaction of the lever arm with a spoked winding key.

As previously mentioned, the attachment device 114 of the present invention may be used to activate an audible, general alarm in response to actuation of one of the temperature sensitive alarms 110 (*a*) through (*c*). This may be accomplished, for example, by direct wiring the leads 180 of the attachment device 114 to a siren 190, as shown in FIG. 8, so that the siren 190 produces an audible tone when the switch 166 is actuated and terminates the audible tone when the switch 166 is deactuated. Alternatively, the siren 190 and switch 166 may be coupled together by a radio link rather than by direct wiring. Since the switch 166 is repeatedly actuated and deactuated by the rotation of the winding key 130 (FIG. 1) as described above, such actuation and deactuation of the switch 166 will also repeatedly activate and deactivate the siren 190 to produce respective periodic audible tones. Such periodic audible tones command more attention that continuous audible tones, and therefore, are more likely to be noticed by building occupants.

The frequency of these periodic tones may be controlled by varying the number of spokes or radial members protruding from the winding key 130 (FIG. 1). For example, a winding key 192 with four spokes 194, as shown in FIG. 8, when utilized with the fire alarm device disclosed in U.S. Pat. No. 3,804,054, opens and closes the switch 166 at a rate which produces an audible tone pattern having a frequency of about two seconds and a tone duration of about one second. That is, the siren 190 sounds a one-second tone every two seconds. Increasing or decreasing the number of spokes 194 will affect the tone pattern accordingly.

The number of tones per revolution of the winding key 192 is equal to the number of spokes 194. Further, since the switch 166 changes state at the beginning and end of each tone, the total number of such changes of state in a given time period is equal to twice the number of spokes 194 times the number of revolutions in such time period.

Thus, the spoked winding key 192 of the present invention permits the attachment 114, when coupled to the siren 190, to produce an intermittent signal pattern having a predetermined frequency and tone duration. Further, since expensive electronics are not required use of the winding key 192 permits such signal patterns to be produced at a low cost.

What is claimed is:

1. An attachment for converting a single station, mechanical spring-powered temperature sensitive fire alarm protection device into a remote signalling temperature detector for a central fire alarm system without modifying in any way either the internal apparatus of said fire protective device or the environmental protection for said internal apparatus, said attachment comprising:

a permanent magnet for producing a magnetic field;

an electrical switch, in juxtaposition to said magnet, which is activated by applying an external magnetic field to said switch;

a movable shield member of magnetizable material having a first position located between said magnet and said switch to substantially shield the switch from said magnetic field, and a second position, at least partially removed from between said magnet and said switch, to expose said switch to at least a portion of said magnetic field, said portion of said magnetic field activating said switch, and the magnetic force of said field upon said shield tending to retain said shield in said first position;

a lever attached to said movable shield for moving said shield from said first to said second position;

said mechanical fire alarm protection device having (i) an externally accessible winding key which rotates when said fire alarm protection device is actuated, said winding key having at least one protrusion, and (ii) a mounting wall bracket for mounting said device; and a housing for mounting said magnet, said switch, and said movable shield as a unitary assembly upon said mounting wall bracket, said lever extending from said unitary assembly so that (i) as said winding key rotates, said protrusion engages said lever to move said shield from said first position to said second position upon actuation of said fire alarm protection device, (ii) the electrical state of said switch is changed by such actuation of the alarm, and (iii) as said winding key continues to rotate said winding key ceases to engage said lever and the magnetic force of said field pulls said shield back to said first position.

2. An attachment for interfacing a single station, mechanically operated, temperature sensitive fire alarm protection device with a central fire alarm system, without disassembling said alarm device or affecting its structural integrity or environmental protection, comprising:

an electrical switch which is activated by selectively applying a magnetic field to said switch;

a magnet for producing a magnetic field;

means external to said alarm device for selectively applying said magnetic field to said switch;

said alarm device having an externally accessible mechanical member which moves in response to actuation of the alarm device, said applying means responsive to the movement of said mechanical member to activate said switch upon actuation of the alarm device; and means for automatically resetting said applying means after said applying means responds to the movement of said mechanical member to reset said switch so that said applying means can respond to subsequent movement of said mechanical member to reactivate said switch.

3. An attachment, as defined in claim 2, wherein the magnetic force produced by the magnetic field of said magnet is substantially greater than is necessary to activate said switch.

4. An attachment, as defined in claim 2, wherein said electrical switch is in juxtaposition with said magnet and said means for selectively applying said magnetic field to said switch comprises:

a movable shield member of magnetizable material having a first position located between said magnet and said switch to substantially shield said switch from said magnetic field, and a second position exposing said switch to at least a portion of said magnetic field sufficient to cause actuation of said switch.

5. An attachment, as defined in claim 4, wherein the magnetic force of said field upon said movable shield member tends to retain said shield member in said first position.

6. An attachment, as defined in claim 4, additionally comprising:

a housing for containing said magnet, said switch, and said movable shield, wherein said movable shield is pivotally mounted in said housing to move in an arcuate path from said first position to said second position; and a lever, attached to said movable shield member, said lever moving said shield member from said first position to said second position in response to movement of said external mechanical member of said alarm device.

7. An attachment for converting a single station, mechanically operated, temperature sensitive fire alarm protective device, producing an audible alarm when activated, into a remote temperature detector for signalling a central monitor upon actuation of said device, said attachment comprising:

an electrical switch;

mechanical means for changing the electrical state of said switch; and a housing for mounting said electrical switch on the exterior of said alarm device, said alarm device having an externally accessible mechanical member which moves in response to actuation of said alarm device, said mechanical means responding to such movement to change the electrical state of said switch;

wherein said mechanical means for changing the electrical state of said switch comprises:

a movable lever member having a first position corresponding to one of said electrical states and a second position corresponding to the other of said electrical states, said lever moving from said first position to said second position in response to movement of said mechanical member of said alarm to change the electrical state of said switch; and means, independent of said mechanical member, for automatically returning said lever to said first position after said mechanical member has moved said lever to said second position.

8. An attachment, as defined in claim 7, wherein the electrical state of said switch is controllable by applying an external magnetic field to said switch, and said mechanical means comprises:

a magnet for producing a magnetic field; and means for applying said magnetic field to said switch, said applying means changing the strength of said magnetic field at said switch to control the electrical state of said switch.

9. A fire alarm system, which combines the reliability of mechanically operated, single station fire alarms with the monitoring capabilities of electrically operated central fire alarm systems, comprising:

a mechanically operated, single station, temperature sensitive fire alarm protection device having an audible alarm which sounds upon actuation of said device;

interfacing means, externally attached to said alarm device, for interacting with said alarm device and converting said alarm device into a remote signalling heat detector for said central fire alarm system;

signalling means, connected to said interfacing means, for initiating a signal in response to actuation of said alarm device; and monitoring means, located remotely from said alarm device, for generating a warning signal in response to said signal initiated by said signalling means, to indicate that said alarm device has been actuated.

10. A fire alarm system, as defined in claim 9, wherein said alarm device has an externally accessible member which moves in response to actuation of said alarm device and said interfacing means comprises a movable member which moves in response to the movement of said external member to enable said signalling means to signal said monitoring means.

11. A fire alarm system, as defined in claim 10, wherein said interfacing means additionally comprises:

an electrical switch activated by applying a magnetic field to said switch;

a magnet for producing a magnetic field; and means, attached to said movable member, for selectively applying said magnetic field to said switch.

12. A fire alarm system, as defined in claim 11, wherein said electrical switch is in juxtaposition with said magnet and said means for selectively applying said magnetic field comprises:

a movable shield member of magnetizable material having a first position between said magnet and said switch to substantially shield said switch from said magnetic field, and a second position exposing said switch to at least a portion of said magentic field sufficient to cause activation of said switch.

13. A fire alarm system, as defined in claim 12, wherein the magnetic force of said field upon said shield tends to retain said shield in said first position.

14. A fire alarm system, as defined in claim 9, wherein said second means comprises a signal transmitter.

15. A fire alarm system, as defined in claim 9, wherein said second means comprises a hard-wired circuit connecting said third means to said first means.

16. A fire alarm system, as defined in claim 9, wherein said signalling means is adapted to initiate an intermittent signal.

* * * * *